United States Patent [19]

Mammino

[11] 4,064,285

[45] Dec. 20, 1977

[54] ELECTROPHOTOGRAPHIC DECALCOMANIAS

[75] Inventor: Joseph Mammino, Penfield, N.Y.

[73] Assignee: Xerox Corporation, Stamford, Conn.

[21] Appl. No.: 643,068

[22] Filed: Dec. 22, 1975

[51] Int. Cl.[2] ..... B44C 1/16; G03G 13/16

[52] U.S. Cl. ..... 427/24; 156/235; 427/148; 428/200; 428/914

[58] Field of Search ..... 427/148, 146, 24, 16; 156/235; 428/200, 914

[56] References Cited

U.S. PATENT DOCUMENTS

| | | | |
|---|---|---|---|
| 2,855,324 | 10/1958 | Van Dorn | 117/25 |
| 2,886,464 | 5/1959 | Van Dorn | 117/17.5 |
| 3,386,847 | 6/1968 | McDermott et al. | 117/36.4 |
| 3,658,519 | 4/1972 | Menz | 96/1.4 |
| 3,799,827 | 3/1974 | Takimoto et al. | 156/219 |
| 3,833,293 | 9/1974 | Serio et al. | 355/17 |
| 3,854,942 | 12/1974 | Akman | 96/1.2 |

*Primary Examiner*—James R. Hoffman

*Attorney, Agent, or Firm*—James J. Ralabate; Donald C. Kolasch; Paul A. Leipold

[57] ABSTRACT

A method of decalcomania in which a toner image pattern is formed on a transfer member which is overcoated with a polymeric material. The polymeric material assists in the permanent adherence of the toner imaging pattern to cloth material or other substrate under heat and pressure. The transfer member and method of its use are described.

54 Claims, 5 Drawing Figures

ELECTROPHOTOGRAPHIC DECALCOMANIAS

BACKGROUND OF THE INVENTION

This invention relates to xerographic reproduction and specifically to a method of transferring xerographically reproduced images to cloth materials and other substrates such as polymer sheets to form permanent images. A method of forming xerographically reproduced permanent images on cloth would be useful as it would allow low-cost production of images on cloth for personalization of articles and formation of low-cost decorated clothing, household goods, decorative items, draperies or bedding. The formation of images on cloth heretofore could only be performed by expensive silk screening operations or by transfer of materials such as decals onto cloth. Even in the case of decals, while they allow a large variety of messages and images, there is still the limitation that the decals need to be separately formed usually in large quantity and do not allow the maker of the decorative item to personalize the decoration to any great extent. Therefore, an easy and inexpensive means for the production of images on cloth has been sought whereby any pictures or messages on paper could be reproduced on cloth cheaply and accurately.

The advent of xerography and electrostatic copying as generally disclosed by Carlson in U.S. Pat. No. 2,297,691 has proven to be a highly successful process for reproduction with the inherent advantages of speed and reliability. In a usual xerographic process, an electrostatic image on an object is formed on a recording member such as a xerographic plate or drum. The xerographic plate may comprise a layer of photoconductive material, such as selenium on a conductive metal backing. The latent electrostatic image which is formed on the photoconductive material is developed into a powder image which is then subsequently transferred on a sheet of paper and affixed thereon to form a permanent print.

The xerographic process has therefore proven to be an easy and reliable means for the production of transparencies. Transparencies made by a xerographic process are produced by forming an electrostatic image of the desired object, developing it, and then transferring it to a transparent sheet material with the image being permanently affixed or fused thereto by either the application of heat or by the action of a solvent vapor. In either case the toner which is used to develop the powdered image is coalesced on the sheet material by the fusing technique to form a permanent image thereon. Solvent fusion techniques for transparent materials made by a xerographic process, for example, are illustrated in U.S. Pat. Nos. 3,049,810 and 3,148,078.

While the xerographic reproduction process is an apparent solution to the problem of economical and efficient production of cheap, individualized images on cloth, other problems have been encountered with its use in the production of such images. One of the most pronounced problems with producing cloth images or images on polymer sheets from xerographically produced images is the failure of the toner powder or developed toner image to adhere well to the cloth material. Images produced xerographically and then transferred to paper are generally fixed to paper by the action of heat and pressure within the copying machine. However, there are problems with the feeding of cloth in a xerographic machine and further there are problems in transfer of the powder image to a cloth material.

It has been proposed that a fused colored xerographic toner image produced on a paper having a release coating be transferred to cloth by the action of heat and pressure to result in the transfer of the image to the cloth. However, such an image is not satisfactory as it does not have resistance to washing and has a tendency to crack when the cloth is flexed.

SUMMARY OF THE INVENTION

It is therefore an object of this invention to provide a method of imaging overcoming the above-noted deficiencies.

It is another object of this invention to provide clear color images on cloth.

It is a further object of this invention to provide a method of fixing colored images to cloth.

It is an additional object of this invention to provide low-cost individual images on cloth.

It is a still further object of this invention to provide long lasting and xerographically produced images on cloth.

It is again an object of this invention to provide a method of fixing xerographic images to cloth.

It is a further additional object of this invention to provide a method of storing and shipping xerographically produced toner images prior to their transfer to cloth.

It is an object of this invention to provide a substrate onto which xerographic images may be transferred for later permanent transfer to cloth.

It is also an object of the present invention to provide for production of color images on cloth by xerographic color imaging process which in turn eliminates the skill of a technican who is trained in reproduction photographic processing.

It is an additional object of the present invention, therefore, to provide for an image on cloth or other substrate which is a multi-colored xerographic image permanently affixed with uniform and constant color reproduction, density and permanence.

It is an additional object to provide permanent xerographic images on wood or polymeric sheet material.

The above objects and others are accomplished generally by providing a silicone coated sheet which is overcoated with a subbing layer onto which toner is transferred in the copying machine. The toner image on the subbing layer may then be transferred by heat to form with the subbing layer a permanent image on cloth. The term "subbing layer" is used herein to include a layer of material which promotes transfer and adherence of toner to cloth under heat and pressure but forms a surface at ordinary temperatures so as to allow the use of a sheet having the subbing layer in a xerographic reproduction machine. The invention further encompasses wherein the toner resting on said coated paper is overcoated with another material which further assists in the transfer and permanent adherence of the toner to cloth material. In an additional embodiment, the invention encompasses the formation of permanent images on polymeric sheet material.

BRIEF DESCRIPTION OF THE DRAWINGS

The advantages of the improved method of transfer of toner images to cloth or other substrates will become even further apparent upon consideration of the following disclosure of the invention particularly when taken in conjunction with the accompanying drawings wherein.

DETAILED DESCRIPTION OF THE DRAWINGS

Figure 1:
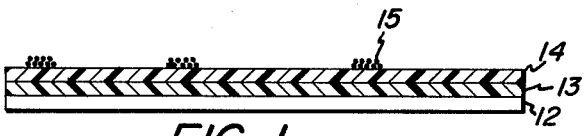
FIG. 1 is a cross section of one image transfer member in accordance with the invention.

FIG. 1 represents a transfer member in accordance with the invention. Substrate 12 supports a layer 13 of silicone resin or other release material. Subbing layer 14 is a material which will aid in the fixing of the toner material to cloth under heat and pressure and which will at normal temperatures be able to operate in a conventional xerographic reproduction machine. Toner 15 is composed of colorant material and a resin. Toners suitable for use in the subject invention are disclosed in U.S. Pat. No. 3,804,619 which is incorporated by reference.

Figure 2:
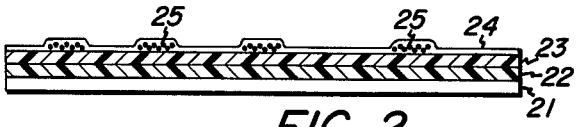
FIG. 2 is a cross section of another embodiment of a transfer member in accordance with the invention wherein the toner is overcoated.

FIG. 2 represents another embodiment of the invention in which there is an overcoating layer applied over the toner image in order to aid in transfer and also allow transport of the imaged sheet with less possibility of disturbing the toner image. The substrate 21 is overcoated with a release layer 22 formed of adhesive material such as silicone and thereover coated with a subbing layer 23 to aid in transfer. The toner image 25 has been overcoated 24 with a plasticizer or resin composition which both aids in transfer and makes the image more permanent for transport of the imaged transfer member.

Figure 3:
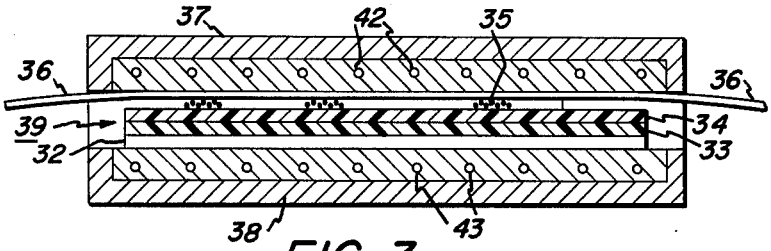
FIG. 3 represents a cross section of apparatus used in transfer to a cloth article.
Figure 4:
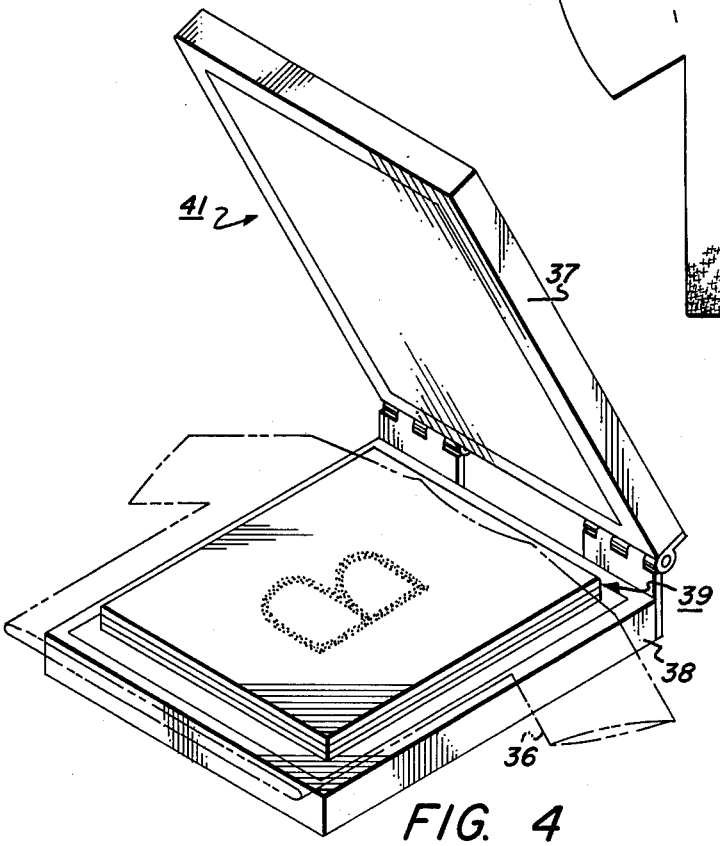
FIG. 4 is the apparatus of FIG. 3 shown in an open position prior to when fixing to the cloth takes place.

FIG. 4 represents a device for transferring the substrate bearing a toner image as illustrated in the cross sections of FIGS. 1 and 2 to a cloth material. The cloth represented by a shirt 36 is placed on the lower member 38 of the heated platen and press represented by 41. The transfer sheet 39 has been placed on the lower platen with the toner image facing up toward the cloth. The upper platen 37 is then brought down to effect transfer of the toner image to the cloth. As illustrated in FIG. 3, which is a cross section of the press 41, when it is closed for transfer of a toner image to cloth, the press may be heated on one or both platens. The temperature may be controlled by regulation of the temperature of heater elements 42 in the upper platen and heater elements 43 in the lower platen. The transfer sheet of FIG. 3 consists of the toner material 35 which rests on a subbing layer 34 that has been formed on a silicone layer 33, which is carried by a substrate 32 of paper or plastic material. It also is possible to first place the cloth in the press and then place the member bearing the toner image over the cloth.

Figure 5:
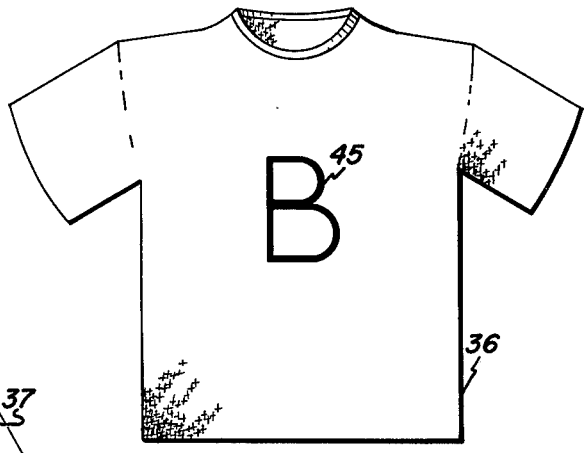
FIG. 5 illustrates an article formed by the process of the invention.

FIG. 5 illustrates a T-shirt 36 onto which has been transferred a color image 45. While the invention has been illustrated using a platen press, it also could be performed with other means of applying heat and pressure to a composite of cloth and the toner carrying substrate. Other means to effect transfer are heated rollers, a heated plate of only one side such as a flat iron preferably used in combination with a heat insulating opposing surface and radiant heaters in combination with unheated rollers.

The method of forming full color images by multicolor electrophotographic printing is well known. The method and materials suitable for such process have been disclosed in U.S. Pat. Nos. 3,833,293 and 3,804,619 which are incorporated by reference. Color electrophotography with multiple development techniques is capable of producing color reproductions employing multiple sequencing of electrophotographic charging, exposing and developing steps with colored toners. A suitable photoconductor such as selenium or zinc oxide photoconductive paper is electrostatically charged uniformly in the dark, then exposed through a green filter to an imagewise projection of a color image to form an electrostatic latent image on the photoconductor. The electrostatic latent image is then developed with the complementary magenta colored toner to form a magenta colored image corresponding to said electrostatic latent image and transferred in register to an image receiving member. The photoconductor is then again electrostatically charged uniformly in the dark and then exposed through a red filter to an imagewise projection of a color image in register with said magenta developed image to form a second electrostatic latent image, which said second image is developed with a complementary cyan colored toner and likewise electrostatically uniformly charged in the dark and then exposed through a blue filter to an imagewise projection of a color image in register with said magenta and cyan developed images to form a third electrostatic latent image wich is then developed with the complementary yellow toner and again transferred in register. This electrophotographic process with superimposed development to obtain images of cyan, magenta and yellow, respectively, is capable of producing multi-colored images by employing toners of different colors. The sequence of exposures to colored filters in this multiple development process may be performed in any suitable sequence other than the green, red and blue sequence recited above. Each developer employed comprises ordinarily a toner or a colored resin mixture in combination with a carrier. The conventional development system is a cascade or magnetic brush development system. When the process of the instant invention is performed, the conventional development and transfer process is performed to transfer the color image comprised of the magenta, cyan and yellow toners onto the member comprising a substate overcoated with a release material and further overcoated with a subbing layer. This member carrying the toner image is then generally removed from the machine without fusing. This may be done by either disconnecting the fuser system, separating the fuser rolls, or removing the fuser entirely. In that embodiment of the invention in which the toner image is overcoated, the toner is normally slightly fused in order to allow coverage with the overcoating without disturbing the image. Slight fusing to allow easier handling may also be carried out in the embodiment wherein no overcoating is applied.

Toners suitable for the invention include any conventional toner material. Typical of such materials are thoe disclosed in U.S. Pat. Nos. 3,909,259 and 3,804,619. Preferred toners for use in the invention are those formed from a 65/35 styrene-n-butylmethacrylate copolymer with a colorant present in an amount of from 2 to 10 parts by weight colorant per 100 parts by weight of the resin material. Preferred cyan colorants are tetra-4-(octadecylsulfonamido) phthalocyanine and Colour Index pigment blue 15, C.I. 74160. A preferred magenta colorant is 2,9-dimethyl-quinacridone identified in the Colour Index as Pigment Red 122. Preferred yellow toner colorants are Colour Index Solvent Yellow 29 C.I. 21230 and Colour Index Pigment Yellow 97. The above resin and toner compositions are preferred as these give exceptional brightness, and desirable fusing and transfer characteristics.

The transfer member of the invention may have as its substrate any suitable material such as paper or plastic. The preferred material is paper due to its low cost and desirable electrostatic properties. The release or abhesive coating overlaying the substrate may be formed of any material which exhibits release properties to resins forming the subbing layer. Suitable materials are fluorinated hydrocarbons such as Teflon and silicone release materials which possess suitable abhesive properties and also temperature resistance. A coating comprising melamine formaldehyde and silicone has been found to be suitable.

Typical silicone gums which are of the heat curing or thermally curable type suitable for use in the instant invention include Y-3557 and Y-3602 silicone gums available from Union Carbide Company, New York, New York, as well as #4413 silicone and 190 4427 heat curable silicone gums available from General Electric Company, Waterford, New York. Other typical materials which are suitable include Dow Corning S2288 silicone gum, available from Dow Corning Corporation, Midland, Michigan. The Y-3557 and Y-3602 gums specifically have aminoalkane crosslinking sites in the polymer backbone which react with a diisocyanate crosslinking agent such as a blocked isocyanate over a wide range of temperature and time to produce a durable toner releasable elastomeric film. The time and temperature relationship for crosslinking of all of these different types of gums is controlled by the chemistry of the crosslinking agent employed and a large choice of agents are available for this purpose. The present invention is therefore not intended to be limited with respect to either time or curing temperature of these materials or the specific materials used to achieve crosslinking, although heating at temperatures between about 50° C and 300° C will typically cure or convert the silicone gum to a toner releasable silicone elastomer. In the event the RTV silicone gums are employed singularly or in a mixture with a thermally curable gum, typical RTV gums which are suitable include RTV-108, 106, 118 silicone gums available from General Electric Company, Silicone Products Division, Waterford, New York. These gums are capable of being cured to a crosslinked state by standing at ambient temperatures and with exposure to the atmosphere. Any of the above described silicone gums are not dependent on having a specific density of crosslink sites on the polymer, these being capable of variation over a wide operative range and the present invention is not intended to be limited in this respect, with the main criteria being the formation of a non-tacky, durable and toner releasable surface by the process of curing the gum.

Other typical silicones which are of the type suitable for the invention are those disclosed in U.S. Pat. No. 3,386,847, which is incorporated by reference. The silicone compound as therein disclosed may be a mixture containing a major fraction of dimethylsiloxane polymers and a minor fraction of methylhydrogensiloxane polymers in a total of about 30 percent by weight, of the mixture, with approximately 70 percent xylene. Other solvent types of emulsion and organic silicones, including those dilutable by water, may be used. The disclosure included in Pat. No. 2,588,393 are made of reference as teaching, in considerable detail, various combinations of polymers resulting in silicone compounds of the type satisfactory for practicing the instant invention.

The solvent may be an aromatic, such as toluene, or other rapidly evaporable vehicles to make the coating slurry. These vehicles include aliphatics, such as heptane, or chlorinated solvents, such as perchloroethylene. The catalyst can be any of those set out in U.S. Pat. No. 2,588,393, but especially metal salts of an organic acid. The diorgano tin salt of carboxylic acid is preferred.

The subbing layer of the invention may be formed of any suitable polymeric material. The subbing layer is such that it allows operation of the copying machine without jamming and also provides a surface to which the toner will adhere and transfer thereto in the copier. A suitable material would be one that serves to transfer and bind the toner material into the cloth or other substrate under heat and pressure. Such a material ordinarily will plasticize and be compatible with the resin of the toner when both are fluidized by heat. The subbing layer further is selected so that it becomes flowable at a temperature compatible with the melting temperature of the toner which is used. The subbing layer ordinarily is colorless so as not to detract from the toner material image which is to be transferred and assists in adherence of the toner to cloth. The subbing layer may be formed by typical forming methods for polymer layers such as hot melt, air knife, roll coating, gravure and wire draw down. The subbing layer typically will be between about 0.1 and about 25 microns. The range of thickness particularly suitable is about 1 to about 15 microns. A range of thickness between about 2 to about 10 microns has been found to be preferred as this results in particularly complete image transfer with low background on the cloth and good permanence. However, it is possible to add a light colorant material to the subbing layer, in order to provide a background of a solid color for the toner image. Typical of such polymer materials are polyvinyl chloride, polyvinyl acetate, polymethylmethacrylate, polyethylmethacrylate, polybutylmethacrylate, polyvinylidene chloride, and mixtures, blends and copolymers of these materials which are applied from either emulsions, dispersion solutions or latexes. Suitable materials for the subject invention are methyl-n-butylmethacrylate copolymers, polyvinyl acetate homopolymer emulsions, vinyl chloride homopolymer latexes and vinyl chloride acrylate latexes and combinations of the above. A preferred subbing layer polymer is a vinyl chloride — vinyl acetate copolymer resin mixed with either ethylmethylacrylate or n-butylmethacrylate polymer which may be applied from a methylethyl ketone solvent as this material gives good image transfer, good fixing and ease of formation.

The material used in the embodiment of the instant invention in which the toner and subbing layer are overcoated after toner application to the subbing layer may be any material which will serve to assist in binding the toner to the subbing layer and at the same time assist in fixing of the toner material to cloth or other substrate during transfer. The overcoating material is generally clear, although in certain instances it is desirable that it may have a color to form a background on the cloth for the colored toner image. The overcoating may be applied at any time after formation of the toner image on the subbing layer. The overcoating may be one which dries to a hard non-tacky surface or if the transfer member does not need to be stored or transported an overcoating which remains liquid or renders the surface tacky may be utilized. The application methods correspond to those set forth for the subbing layer. The layer thicknesses for those overcoatings which solidify also correspond to those of the subbing layer. If the overcoating remains liquid then the typical liquid thickness is about 0.01 to 5 microns. The range of thickness particularly suitable is about 0.1 to 2 microns liquid thickness. A preferred thickness of liquid coating is between about 0.1 and 1 micron to result in complete transfer and low polymer background on the cloth. The overcoating material may be composed of any material which is a solvent or plasticizer for the toner and/or the subbing layer at the temperatures of transfer. The overcoating composition may be the same as the composition of the subbing layer. The overcoating may comprise a polymer, latex or a highly plasticized compound. Typical of plasticizers suitable for use in both the subbing and overcoating layers are those disclosed in the 1971–1972 Modern Plastics Encyclopedia, pages 653 to 664. Typical of materials suitable for the overcoating are thin layers of materials formed from esters, hydrocarbons, phenoxy plasticizers, phthalic acid derivatives, oleates, stearates, phosphoric acid derivatives and mixtures of these materials. Among those preferred for the process are di-2-ethylhexylphthalate, diisooctyladipate and diphenylphthalate and mixtures of these materials as they result in particularly good fix of the material to the cloth or other substrate and may be effectively coated onto the toner image in order to aid in stabilization of that image.

Cloths suitable for use in the invention may be formed of any material to which toner may be affixed. Cloth may be selected from cotton, polyester, wool, nylon, or blends thereof. The term "cloth" also is used to include both woven and nonwoven materials such as felting. The cloth may be in the form of a finished article or as bolt material which is used and subsequently formed into articles. Cloth may be in the form of shirts, pillowcases, sheets, or sizes suitable for forming wall hangings. Preferred materials for transfer in the invention are woven cotton, polyester and blends thereof which result in good quality permanent images.

In utilizing the process of the instant invention for transfer to other mediums than cloth, it is possible to utilize any medium which is not degraded by the heat of the transfer conditions and to which the toner will adhere with the aid of the method of the instant invention. Typical of suitable noncloth materials are glass, metals such as steel and aluminum, ceramic materials, special purpose papers and polymeric materials formed of polyesters such as polyethylene terephthalate, polycarbonates, acrylonitrile polymers, elastomers such as ABS, butadiene, gutta-percha and polyurethanes. Mediums formed of natural materials such as wood or leather are also of the type suitable for the process of the invention. The composite leather substitutes often of vinyl or polyurethane fiber reinforced such as Corfam and Naugahyde also are a type of material suitable for the process of the invention. A preferred non-cloth transfer receiving medium is polyvinyl chloride sheet material as this material allows good fixing and clear bright images. Further vinyl chloride is preferred as it is suitable for many uses where decoration is desirable such as book covers and shower curtains.

PREFERRED EMBODIMENTS

The following examples further define, describe and compare methods of preparing the transfer members of the invention and in carrying out the process of transfer of images to cloth material and other materials. Parts and percentages are by weight unless otherwise indicated.

EXAMPLE I

A transfer member is prepared as follows: A paper sheet 10 × 15 inches is film coated using a draw bar with a 10 percent weight solution in benzene of Y-3557 silicone gum available from Union Carbide Company, New York, New York, containing a blocked aromatic diisocyanate, specifically the acetone oxene adduct of toluene-2,4-diisocyanate as a crosslinking agent in an amount of about 0.5 to 1.5 by weight. The coating is allowed to air dry to remove the solvent leaving the layer with a thickness of between about 5 to about 8 microns. The plate is air dried for approximately 20 minutes at room temperature to remove residual traces of solvent. This sheet is then placed in a forced air oven and heated at 175° C for about 2 minutes in order to cure the silicone surface. The silicone coated sheet produced thereby is coated with a solution of about 7.0 grams VYNS, a 90 percent vinyl chloride/10 percent vinyl acetate copolymer resin from Union Carbide, and about 3.0 grams of Elvacite 2042, an ethylmethacrylate polymer from DuPont in about 90 grams of methylethyl ketone as a solvent. The coating is applied by wire draw down and forced air dried to form the subbing layer having a dry film thickness of about 5 microns. A Xerox 6500 color copier was set to operate to produce a minimum fused image on the coated silicone release paper.

The Xerox 6500 color copier utilized in all Examples is operated using toners formed of 65/35 styrene-n-butylmethacrylate as the resin which is combined with about 2 to about 10 parts of a colorant. The cyan colorant is tetra-4-(octadecylsulfonamido). The magenta colorant is Colour Index Pigment Red 122. The yellow colorant is Colour Index Pigment Yellow 97 generally described in U.S. Pat. No. 2,644,814 and satisfying the formula:

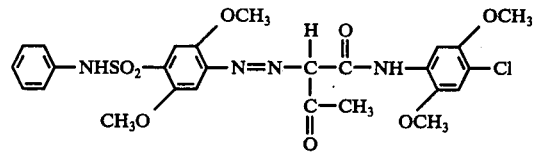

The coated silicone sheet bearing the slightly fused toner image is then overcoated with a coating of clear diisooctyladipate plasticizer. This overcoated imaged sheet is then placed in face contact with a piece of cloth and put into a laminating press set at 350° F to 390° F for 30 seconds. The cloth is formed of a woven cotton and polyester blend having a polyester content of about 50 percent. The press is opened and the paper and cloth removed and allowed to cool to room temperature. The silicone release paper is peeled from the cloth to reveal a uniform almost 100 percent transfer of the image to cloth. The image is totally driven into the cloth through the action of heat, pressure and plasticizer. The transfer is so complete and totally into the cloth that a backing absorption sheet would be required to prevent toner strike through to the next layer of cloth if present. The cloth is not discolored or otherwise damaged by the plasticizer. The image is not damaged by washing or flexing.

EXAMPLE II

A release paper having a paper substrate coated with a melamine formaldehyde-silicone release coating is coated with a subbing layer of the following composition. About 40 grams VYNS, a vinyl chloride/vinyl acetate copolymer resin from Union Carbide; about 10 grams Lucite 2044, a polymer composed of n-butyl methacrylate; about 4 grams of di-2-ethylhexylphthalate; about 6 grams of diisooctyladipate; about 10 grams of diphenylphthalate; and about 270 grams of methylethyl ketone as a solvent. This coating is applied to the silicone release paper by wire draw down and forced air dried. Dry film thickness of the coating is about 10 microns. The Xerox 6500 color copier is set to operate to produce a minimum fused image on the coated silicone release paper. The imaged sheet having the subbing layer is then placed in face contact with a piece of cotton cloth and put into a laminating press at about 350° F for about 30 seconds. The press is opened, the paper and cloth removed and allowed to cool to room temperature. The silicone release paper is peeled from the cloth to reveal a uniform, almost 100 percent transfer of the image to the cloth and the image is driven into the cloth through the action of the heat, pressure and plasticizer. The cloth is subjected to flexing and washing with detergents and retains a permanent image.

EXAMPLE III–VII

The silicone coated sheet of Example I is overcoated with the following subbing compositions. The coating thickness is approximately 8 microns and is coated by a draw down rod.

| Example | Subbing Compositions |
|---|---|
| III | 7 g. n-butyl methylacrylate<br>3 g. vinyl chloride - acetate copolymer resin<br>(86% vinyl chloride, 14% vinyl acetate)<br>1 g. wetting agent<br>(Armostat 310, Armour Industrial Chemical Co.)<br>90 g. methylethyl ketone and toluene at 1:1 weight ratio |
| IV | 7 g. n-butyl methylacrylate<br>3 g. vinyl chloride - acetate - maleic acid polymer resin<br>(86% vinyl chloride, 13% vinyl acetate, 1% maleic acid)<br>1 g. wetting agent<br>(Armostat 310, Armour Industrial Chemical Co.)<br>0.1 g. colloidal silica<br>(Cab-o-Sil, Cabot Corporation)<br>90 g. methylethyl ketone and toluene at 1:1 weight ratio |
| V | 7 g. n-butyl methacrylate<br>3 g. vinyl chloride - acetate - maleic acid polymer resin<br>(83% vinyl chloride, 16% vinyl acetate, 1% maleic acid)<br>1 g. wetting agent<br>(Armostat 310, Armour Industrial Chemical Co.)<br>0.5 g. Carbon Black Pigment<br>90 g. methylethyl ketone and toluene at 1:1 weight ratio |
| VI | 7 g. n-butyl methacrylate<br>3 g. vinyl chloride - acetate - maleic acid polymer resin<br>(81% vinyl chloride, 17% vinyl acetate, 2% maleic acid)<br>1 g. wetting agent<br>(Armostat 310, Armour Industrial Chemical Co.)<br>1 g. Titanium Dioxide<br>90 g. methylethyl ketone and toluene at 1:1 weight ratio |
| VII | 7 g. n-butyl methacrylate<br>3 g. vinyl chloride - acetate copolymer resin<br>(97% vinyl chloride, 3% vinyl acetate)<br>0.5 g. wetting agent<br>(Armostat 310, Armour Industrial Chemical Co.)<br>1 g. Aluminum Flake Pigment<br>90 g. tetrahydrofuran |

Each of these sheets is operated in a conventional Xerox 6500 color copier with the fuser off to form a full color image. The overcoated imaged sheet is then placed in face contact with a woven cotton cloth and put into a laminating press set at about 375° F for about 30 seconds. The press is opened and the paper and cloth removed and allowed to cool to room temperature. The silicone release paper is peeled from the cloth and in each case revealed a uniform, almost 100 percent transfer of the image to the cloth. Each cloth is then flexed and washed and in each case a permanent image was adhered to the cloth.

EXAMPLE VIII–XII

The process of Examples III–VII is repeated except in each instance the toner image is slightly fused and then overcoated after imaging with the following materials respectively:

In Example VIII the imaged sheet of Example III is overcoated with a coating of diisooctyladipate.

In Example IX the imaged sheet of Example VIII is overcoated with a thin coating of diphenyl phthalate.

In Example X the imaged sheet of Example V is overcoated with dicyclohexylphthalate.

In Example XI the imaged sheet of Example VI is overcoated with a thin layer of tributoxyethylphosphate.

In Example XII the imaged sheet of Example VII is overcoated with a thin coating of triethylene glycol di(2-ethylhexoate).

Each of the above Examples is then placed in contact with a woven cloth formed of 25 percent polyester, 75 percent cotton and placed in a heated press at about 350° F for about 30 seconds. The cloth and sheet are removed from the press and allowed to cool. The silicone sheet is stripped from the cloth and a clear, full color image is exhibited on the cloth. Flexing and washing of the cloth do not destroy the image.

EXAMPLE XIII

The sub-coated sheet of Example I is imaged by a Xerox 6500 color copier set in the transparency mode to slightly fuse the image. The imaged sub-coated paper was then overcoated with a light coat of Decal-IT, a vinyl chloride latex available from Connoisseur Studio Inc. This transfer sheet was then placed in contact with a cotton woven cloth and placed in a heated press from about 30 seconds at about 375° F. The cloth and transfer sheet were removed from the press and allowed to cool. The silicone coated sheet is stripped from the cloth and a full color image is found to be transferred to the cloth. Flexing, abrasion, and washing of the cloth do not destroy the image.

EXAMPLES XIV–XVI

The process of Examples III–V are repeated except a sheet of polyvinyl chloride of about 75 microns thickness is substituted for the cloth material. The image produced is of good quality and is not dislodged by flexing.

EXAMPLES XVII–XIX

The process of Examples VIII, IX and X is repeated except an about 50 microns thickness sheet of Mylar, a polyethylene terephthalate, is substituted for the cloth. The image is found to be almost completely transferred and is not dislodged by flexing.

EXAMPLES XX–XXII

The process of Examples III, IX and X is repeated except an about 75 microns thickness polyethylene sheet is substituted for the cloth. The image is almost entirely transferred and is not dislodged by flexing.

Although specific materials and conditions were set forth in the above exemplary process, in the formation and use of the transfer member of the invention, these are merely intended as illustrations of the present invention. Various other substitutents and processes such as those listed above may be substituted for those in the Examples with similar results. In addition to the steps used to prepare the transfer member and to effect transfer from the transfer member of the toner, other steps or modifications may be used if desirable, i.e. steps to prevent image reversal. In addition, other materials may be incorporated into the toners or transfer members of the invention which will enhance, synergize or otherwise desirably effect the properties of these materials for their present use. For example, the transfer may be made by plasticization of the toner and subbing layers by a solvent rather than by heat. Also the transfer may be carried out by the separate steps of first heating the transfer member and cloth and then subjecting them to pressure. It is further possible to incorporate elements sensitive to black light, luminscent or reflective, into the toner material for formation or safety garments or decorative items.

Other modifications of the present invention will occur to those skilled in the art upon reading of the present disclosure. For instance, it is possible to superimpose several images onto one cloth to obtain interesting effects. The process further would be suitable for use with only black toner or toner of a single color rather than full color as set forth in the above Examples. The process further may be carried out for special applications with releasable images on both sides of the transfer member to transfer two images in one use of the press. Additionally, the process may be carried out with receiving mediums which are not sheets. For instance, the instant invention may be used to decorate furniture or other finished articles such as vinyl car tops, walls or toys. These and other modifications are intended to be included within the scope of this invention.

What is claimed is:

1. A method of decalcomania comprising xerographically forming an image pattern of toner, transferring said image to a subbing layer material which rests on an abhesive member, contacting said image carrying member with a cloth, heating said image carrying member while in contact with said cloth and separating said imaged member and said cloth to produce a cloth bearing a permanent image.

2. The method of claim 1 wherein said abhesive material is selected from the group consisting of silicone and fluorinated polymers.

3. The method of claim 1 wherein said subbing layer comprises a low melting temperature polymer selected from the group consisting of polyvinyl chloride, polyvinyl acetate, polymethylmethacrylate, polybutylmethacrylate, polyvinylidene chloride and mixtures, blends and copolymers thereof.

4. The method of claim 3 wherein said subbing layer further comprises a plasticizer material selected from the group consisting of esters, hydrocarbons, phenoxy plasticizers, phthalic acid derivatives, oleates, stearates, phosphoric acid derivatives and mixtures thereof.

5. The method of claim 1 wherein said subbing layer comprises a material selected from the group consisting of methyl-n-butylmethacrylate copolymers, polyvinyl acetate homopolymer emulsions, vinyl chloride homopolymer latexes, vinyl chloride acrylate latexes and combinations thereof.

6. The method of claim 5 wherein said subbing layer further comprises a plasticizer selected from the group consisting of esters, adipates and phthalates.

7. The method of claim 1 wherein said toner image pattern is in full color formed by sequential developing with toners of three colors.

8. The method of claim 1 wherein the said abhesive member rests on a substrate.

9. The method of claim 1 wherein said toner and said subbing layer flow into said cloth during said heating.

10. The method of claim 1 wherein said subbing layer is transparent.

11. The method of claim 1 wherein said cloth comprises materials selected from the group consisting of cotton, polyester and blends thereof.

12. The method of claim 1 wherein during said heating pressure is applied.

13. The method of claim 1 wherein said toner comprises styrene-n-butylmethacrylate.

14. The method of claim 1 wherein said subbing layer comprises a colorant.

15. The method of claim 1 wherein said subbing layer is between about 2 to about 10 microns in thickness.

16. A method of decalcomania comprising xerographically forming an image pattern of toner, transferring said toner to a subbing layer material which rests on an abhesive member, coating said toner and subbing layer with overcoating material said overcoating material comprises a plasticizer or solvent for the toner and/or the subbing layer at the temperature of transfer, placing said overcoated image bearing member in face contact with a cloth, applying heat and pressure to said cloth and member and stripping said cloth from said member.

17. The method of claim 16 wherein said abhesive material is selected from the group consisting of silicone and fluorinated polymers.

18. The method of claim 16 wherein said subbing layer comprises a polymer selected from the group consisting of polyvinyl chloride, polyvinyl acetate, polymethylmethacrylate, polyethylmethacrylate, polybutylmethacrylate, polyvinylidene chloride and mixtures, blends and copolymers thereof.

19. The method of claim 16 wherein said subbing layer comprises a material selected from the group consisting of methyl-n-butylmethacrylate copolymers, polyvinyl acetate homopolymer emulsions, vinyl chloride homopolymer latexes, vinyl chloride acrylate latexes and combinations thereof.

20. The method of claim 16 wherein said image pattern is in full color formed by sequential developing with toners of three colors.

21. The method of claim 16 wherein the said abhesive member rests on a substrate.

22. The method of claim 16 wherein said toner and said subbing layer flow into said cloth during said heating.

23. The method of claim 16 wherein said subbing layer is transparent.

24. The method of claim 16 wherein said cloth comprises a material selected from the group consisting of cotton, polyester and blends thereof.

25. The method of claim 16 wherein said overcoating layer comprises a material selected from the group consisting of esters, hydrocarbons, phenoxy plasticizers, phthalic acid derivatives, oleates, stearates, phosphoric acid derivatives and mixtures thereof.

26. The method of claim 16 wherein said overcoating layer comprises a plasticizer for said toner and said subbing layer.

27. The method of claim 16 wherein said subbing layer comprises a colorant.

28. The method of claim 16 wherein said subbing layer is between about 2 to 10 microns in thickness.

29. The method of claim 16 wherein said overcoating is a liquid about 0.1 to about 2 microns in thickness.

30. A transfer member comprising successively an abhesive material, a subbing layer and a xerographically formed toner image.

31. The transfer member of claim 30 further comprising an overcoating layer overlaying the toner and said subbing layer, said overcoating layer comprises a plasticizer or solvent for the toner and/or the subbing layer.

32. The member of claim 31 wherein said overcoating layer comprises a material selected from the group consisting of esters, hydrocarbons, phenoxy plasticizers, phthalic acid derivatives, oleates, stearates, phosphoric acid derivatives and mixtures thereof.

33. The method of claim 31 wherein said overcoating layer comprises a plasticizer for said toner and said subbing layer.

34. The member of claim 30 wherein said abhesive material is selected from the group consisting of silicone and fluorinated polymers.

35. The member of claim 30 wherein said subbing layer comprises a low melting temperature polymer selected from the group consisting of polyvinyl chloride, polyvinyl acetate, polymethylmethacrylate, polyethylmethacrylate, polybutylmethacrylate, polyvinylidene chloride and mixtures, blends and copolymers thereof.

36. The member of claim 35 wherein said subbing layer further comprises a plasticizer material selected from the group consisting of esters, hydrocarbons, phenoxy plasticizers, phthalic acid derivatives, oleates, stearates, phosphoric acid derivatives and mixtures thereof.

37. The member of claim 30 wherein said subbing layer comprises a material selected from the group consisting of methyl-n-butylmethacrylate copolymers, polyvinyl acetate homopolymer emulsions, vinyl chloride homopolymer latexes, vinyl chloride acrylate latexes and combinations thereof.

38. The member of claim 37 wherein said subbing layer further comprises a plasticizer selected from the group consisting of esters, adipates and phthalates.

39. The member of claim 30 wherein said toner image comprises a full color image formed by sequential developing with toners of three colors.

40. The member of claim 30 wherein the said abhesive member rests on a substrate.

41. The member of claim 30 wherein said subbing layer is transparent.

42. The member of claim 30 wherein said toner comprises a styrene-n-butylmethacrylate copolymer.

43. The member of claim 30 wherein said subbing layer comprises a colorant.

44. A decalcomania transfer member comprising a substrate, a silicone polymer overcoating said substrate, a low melting temperature polymeric material overcoating said silicone, a xerographically formed toner image resting on said low melting polymeric material and a plasticizer overcoating said toner image and said low melting temperature polymeric material.

45. The member of claim 44 wherein said substrate is paper and the toner image is in full color.

46. The member of claim 45 wherein said low melting temperature polymeric material comprises a blend of vinyl chloride - vinyl acetate copolymer and ethylmethacrylate polymer or n-butylmethacrylate polymer.

47. The member of claim 46 wherein said plasticizer comprises a material selected from the group consisting of di-2-ethylhexylphthalate, diisooctyladipate, diphenylphthalate and mixtures thereof.

48. A method of decalcomania comprising xerographically forming an image pattern of toner, transferring said image to a subbing layer material which rests on an abhesive member, contacting said image carrying member with a sheet, heating said image carrying member while in contact with said sheet and separating said imaged member and said sheet to produce a sheet bearing a permanent image.

49. The method of claim 48 wherein said subbing layer comprises a material selected from the group consisting of methyl-n-butylmethacrylate copolymers, polyvinyl acetate homopolymer emulsions, vinyl chloride homopolymer latexes, vinyl chloride acrylate latexes and combinations thereof.

50. The method of claim 48 wherein said sheet comprises materials selected from the group consisting of polyvinyl chlorides, polyesters, polyolefins, polycarbonates, polyurethanes, and blends and copolymers thereof.

51. A method of decalcomania comprising xerographically forming an image pattern of toner, transferring said toner to a subbing layer material which rests on an abhesive member, coating said toner and subbing layer with overcoating material, said overcoating material comprises a plasticizer or solvent for the toner and/or the subbing layer, placing said overcoated image bearing member in face contact with a sheet, applying heat and pressure to said sheet and member and stripping said sheet from said member.

52. The method of claim 51 wherein said sheet comprises a material selected from the group consisting of vinyl chlorides, polyesters, polyolefins, polycarbonates, polyurethanes and blends and copolymers thereof.

53. The method of claim 51 wherein said subbing layer comprises a material selected from the group consisting of methyl-n-butylmethacrylate copolymers, polyvinyl acetate, homopolymer emulsions, vinyl chloride homopolymer latexes, vinyl chloride acrylate latexes and combinations thereof.

54. The method of claim 51 wherein said sheet comprises wood.

* * * * *